US005791500A

United States Patent [19]

Burke et al.

[11] Patent Number: 5,791,500

[45] Date of Patent: Aug. 11, 1998

[54] INCLINED DISPLAY RACK

[75] Inventors: Wade P. Burke, Watauga; Ray M. Lewis, II, Fort Worth, both of Tex.

[73] Assignee: Marco Display Specialists, Inc., Fort Worth, Tex.

[21] Appl. No.: 850,605

[22] Filed: May 2, 1997

[51] Int. Cl.[6] ..... A47F 5/00

[52] U.S. Cl. ..... 211/175; 280/79.3; 211/150

[58] Field of Search ..... 211/175, 149, 211/150, 195; 280/79.3

[56] References Cited

U.S. PATENT DOCUMENTS

| | | | |
|---|---|---|---|
| 3,385,452 | 5/1968 | Dantino et al. | 211/175 |
| 4,077,522 | 3/1978 | Trubiano | 211/175 |
| 5,344,033 | 9/1994 | Herman | 211/150 |
| 5,351,976 | 10/1994 | Penson | 280/79.3 X |
| 5,439,122 | 8/1995 | Ramsey | 211/128.1 X |
| 5,477,970 | 12/1995 | Watt et al. | 211/175 |
| 5,503,279 | 4/1996 | Wentworth | 211/175 |
| 5,590,796 | 1/1997 | Herman | 211/149 |

OTHER PUBLICATIONS

Brochure of Item No. BAK–400, The Marco Company.
Brochure of Item No. BAK–402, The Marco Company.
Brochure of Item No. Cart–03, The Marco Company.
Brochure of Cart–02 With Liner and Riser, The Marco Company.
Brochure of Cart–04, The Marco Company.

*Primary Examiner*—Robert W. Gibson, Jr.
*Attorney, Agent, or Firm*—Geoffrey A. Mantooth

[57] ABSTRACT

The inclined display rack has a frame with a base and posts extending therefrom. The posts have supports thereon, with the supports being separated from the base by a distance. There is provided an extension that has first and second ends. The second end of the extension slidingly engages the base so as to move between a fully extended position and a partially extended position. The first end of the extension is closer to the base when the extension is in the partially extended position than when the extension is in the fully extended position. There is also a rack having a main section and one or more secondary sections. The main section has first and second ends, with the first end being pivotally coupled to the first end of the extension. The second end of the main section is pivotally coupled to a secondary section. The rack is received between the posts and bears on the supports such that the main section of the rack is inclined to the base. The secondary section is also inclined when the extension is in the fully extended position, and is either horizontal or inclined to the rear of the display when the extension is retracted into the base.

8 Claims, 8 Drawing Sheets

INCLINED DISPLAY RACK

FIELD OF THE INVENTION

The present invention relates to apparatuses used to display goods, such as food items.

BACKGROUND OF THE INVENTION

Merchandising is the promotion of the sale of an item or product by displaying or advertising the item. For example, grocery stores practice merchandising extensively. This is especially true with baked goods, produce, and meats. The items are displayed for sale on racks or stands or in bins. The objective of merchandising is to attractively display the product to a purchasing customer.

The size of the display is important. Ideally, the display should be large enough to display the desired quantity of products. Empty shelves are not attractive and are avoided by many stores.

As an example of merchandising, many grocery stores have an in store bakery. The baked goods are typically displayed for sale on a rack.

A problem arises with the volume of baked goods that are displayed. Certain days of the week may be slower, from a sales point of view, than are other days of the week. For example, in some stores, customers buy fewer baked goods on Mondays and Tuesdays than on other days of the week.

A conventional rack is undesirable to display such baked goods because of the change in volume of the goods that are to be displayed. A conventional rack may have plural shelves that are stair stepped. If a large rack is used, the rack is satisfactory for Wednesdays through Sundays, when large volumes of baked goods are displayed for sale. However, on Mondays and Tuesdays, such a rack is too large, and presents empty shelves to customers. If a smaller rack is used, the rack is satisfactory for days with low sales volume, but is too small for heavy volume sales days. Small racks on busy days must be frequently restocked, adding to labor costs.

SUMMARY OF THE INVENTION

It is an object of the present invention to provide a rack that can be adjusted to display various amounts of merchandise.

It is an object of the present invention to provide a rack that can be adjusted to display various amounts of merchandise in an easy and aesthetic manner.

The present invention provides a display that comprises a frame, an extension, and a rack. The frame has a base and posts that extend from the rack. The posts have supports thereon, with the supports being separated from the base by a distance. The extension has first and second ends, with the second end slidingly engaging the base so as to move between an extended position and a partially extended or retracted position. The first end of the extension is closer to the base when the extension is in the partially extended position than when the extension is in the extended position.

The rack has a main section and a secondary section. The main section has first and second ends, with the first end of the main section being pivotally coupled to the first end of the extension. The second end of the main section is pivotally coupled to the secondary section. The rack is received between the posts and bears on the supports such that the main section of the rack is inclined to the base. When the extension is in the extended position, the secondary section has the same inclination as the main section. When the extension is in the partially extended position, the secondary section has a different inclination from the inclination of the main section.

In accordance with one aspect of the present invention, the secondary section is horizontal when the extension is in the partially extended position.

In accordance with another aspect of the present invention, the secondary section of the rack depends toward the base when the extension is in the partially extended position.

In still another aspect of the present invention, the display further comprises legs on the base and on the extension. The legs can comprise wheels.

The display can also comprise wagon type wheels that are coupled to the posts.

The display can also have a shelf that is located on the base. The shelf is located such that the posts are between the shelf and the first end of the rack main section.

With the display of the present invention, an inclined rack for displaying products is provided. The length of the inclined rack can be adjusted so as to fit the rack into an available space and also so as to provide more or less shelf space for displaying products. In this manner, the amount of display space can be adjusted according to the amount of products that are required to be displayed on a daily, weekly, or seasonal basis.

DESCRIPTION OF THE PREFERRED EMBODIMENT

Figure 1:
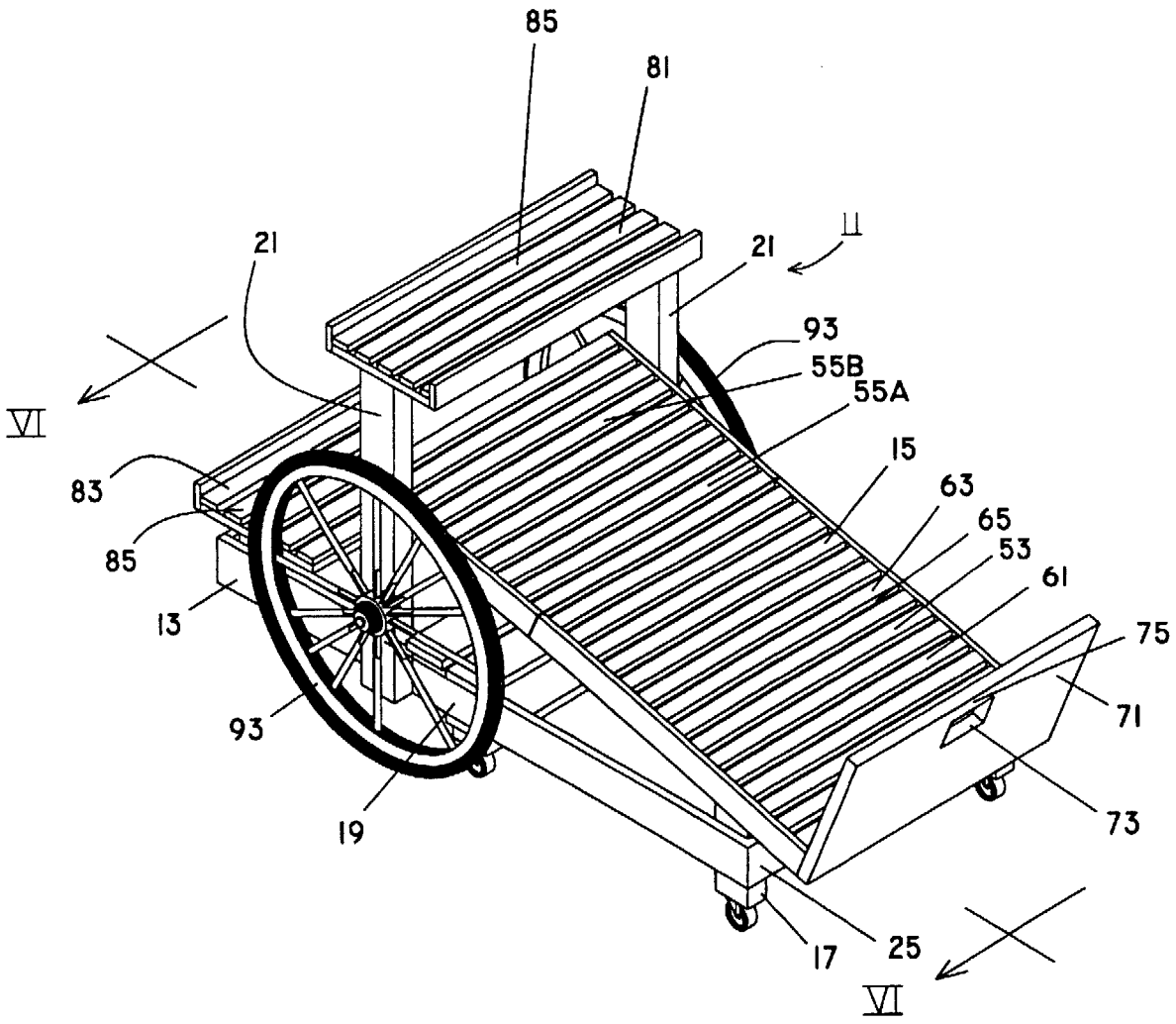
FIG. 1 is an isometric view of the display rack in the fully extended position.
Figure 4:
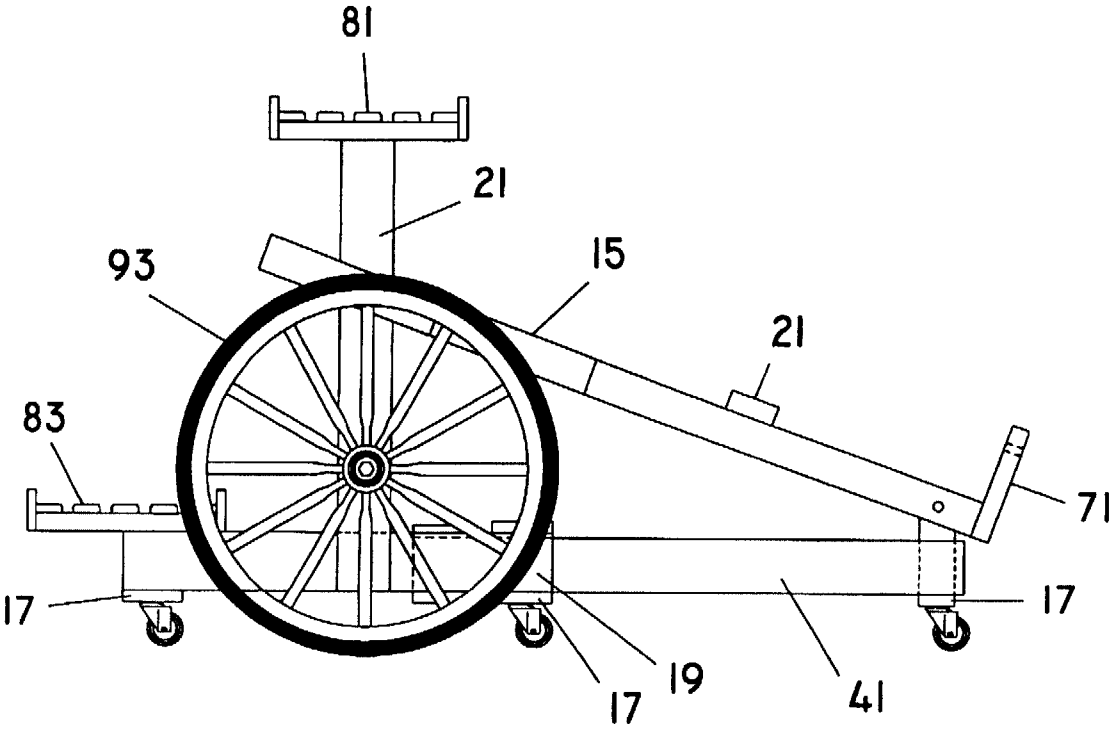
FIG. 4 is a side elevational view of the display rack of FIG. 3.
Figure 5:
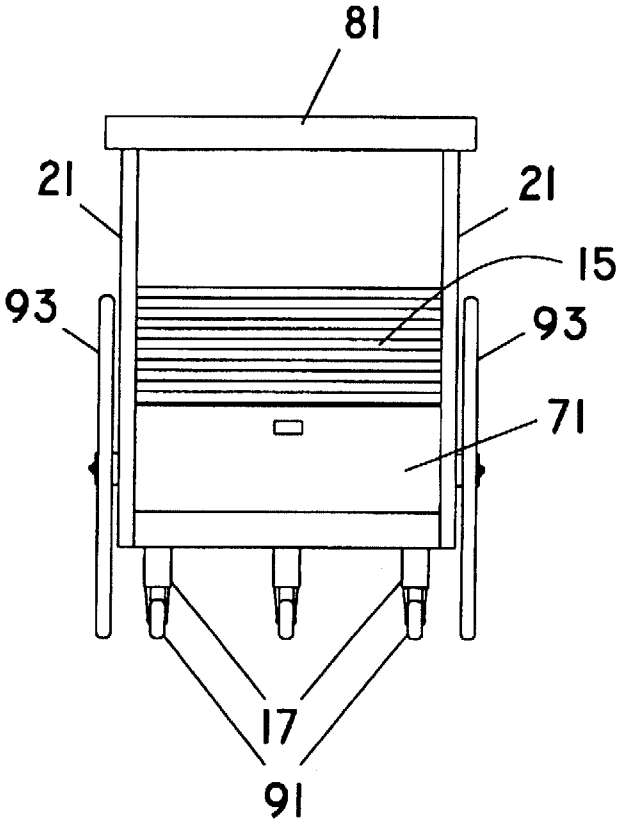
FIG. 5 is a elevational view of the display rack.
Figure 6:
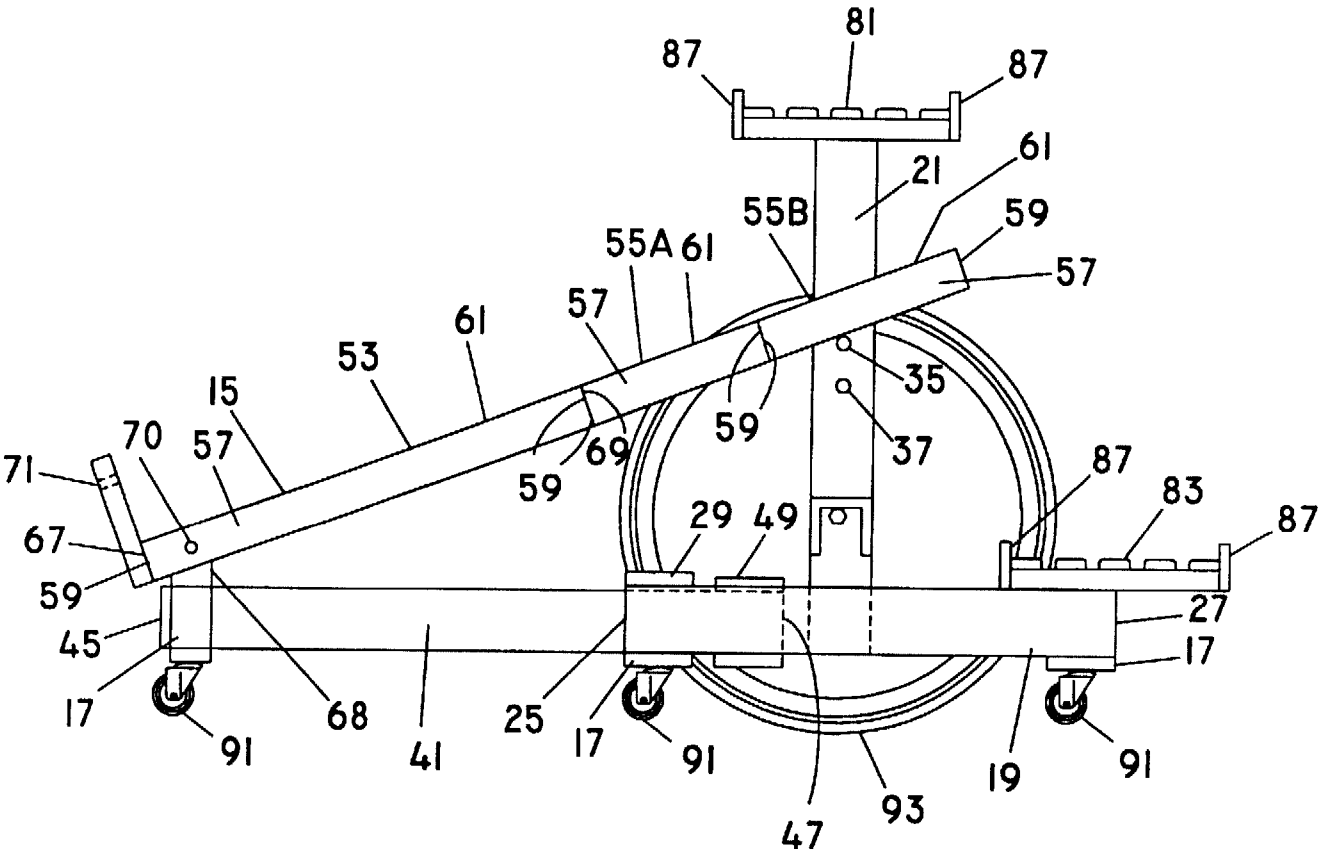
FIG. 6 is a schematic side cross-sectional view of the display rack, taken through lines VI—VI of FIG. 1.
Figure 7:
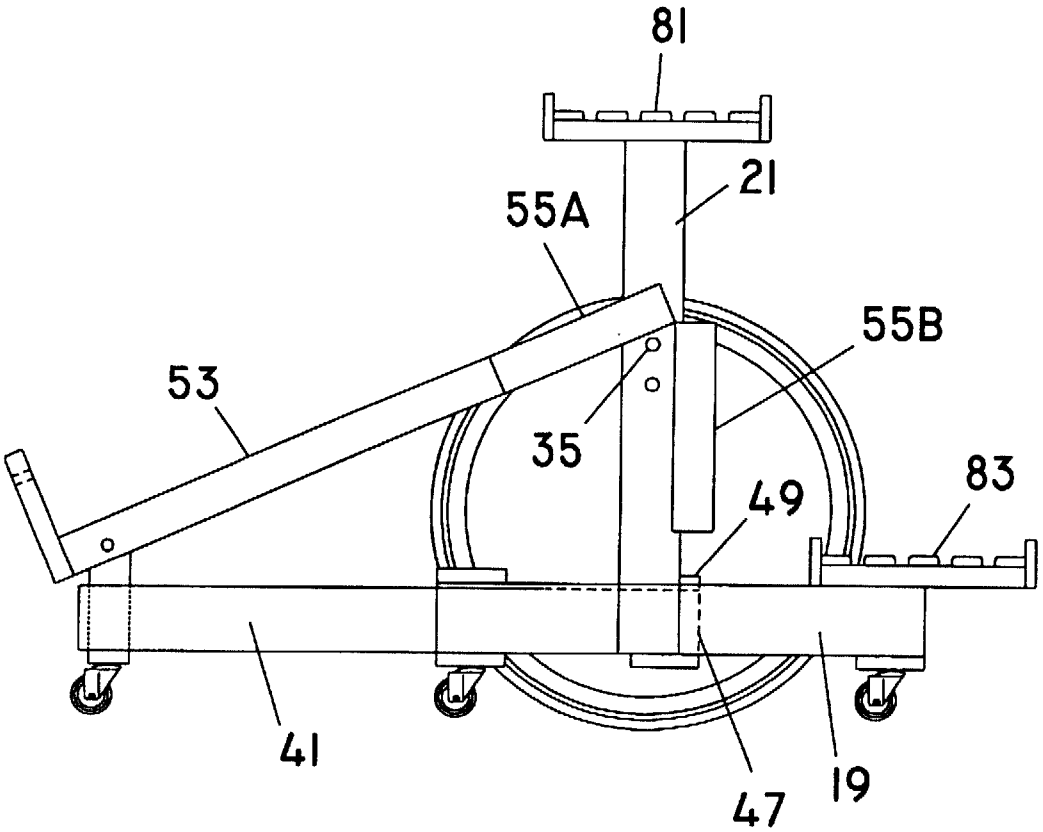
FIG. 7 is a schematic side cross-sectional view of the display rack in a partially retracted position.
Figure 8:
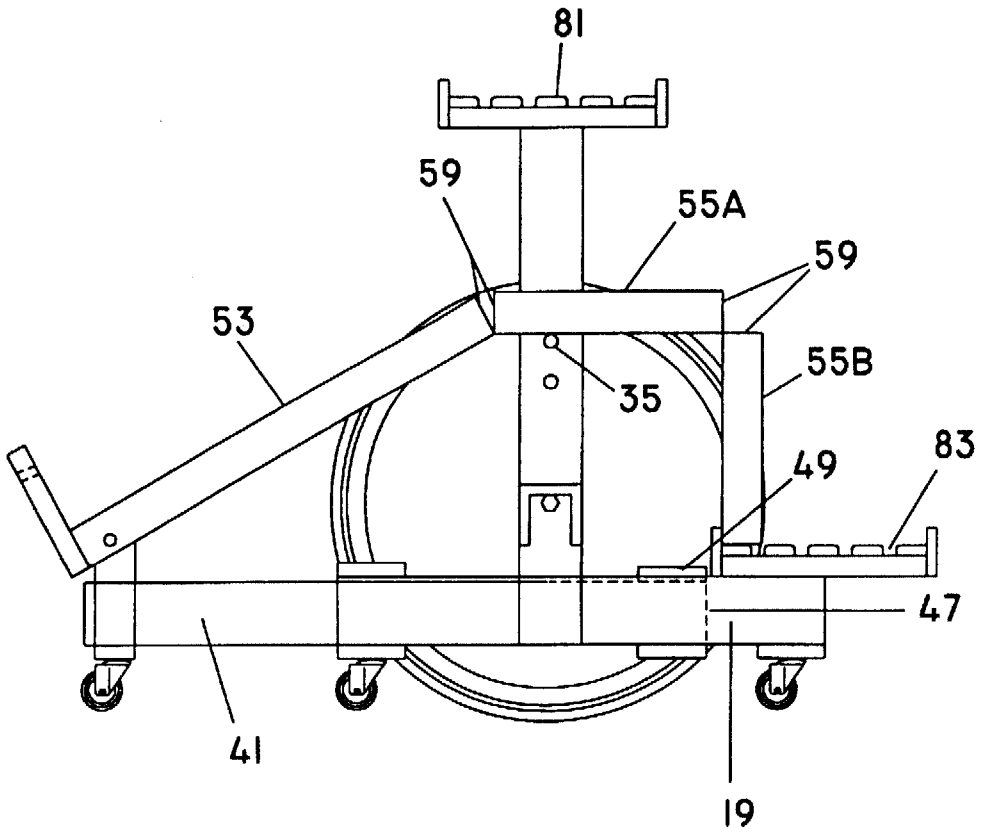
FIG. 8 is a schematic side cross-sectional view of the display rack, in still another retracted position.

Referring to FIGS. 1 and 4, the display rack 11 is used to display products 12 for sale. For example, baked goods or produce can be displayed for sale. The products 12 are placed on an inclined rack 15. The length of the rack 15 can be adjusted so as to expose varying amounts of shelf or rack space. For example, FIGS. 4 and 6 show the rack 15 extended to its fullest length. FIG. 7 shows the rack 15 shortened somewhat. FIG. 8 shows the rack 15 shortened even more. Thus, the rack 15 can be sized to fit in various spaces in a store. In addition, the rack size can be adjusted on a daily, weekly, or seasonal basis to display more or less products for sale, without showing empty shelf space.

Referring to FIG. 1, the display 11 includes a frame 13, a rack 15, and legs 17.

In the description that follows, terms such as "top", "bottom", "front", and "rear", refer to the orientation of the display rack shown in FIG. 1.

Figure 2:
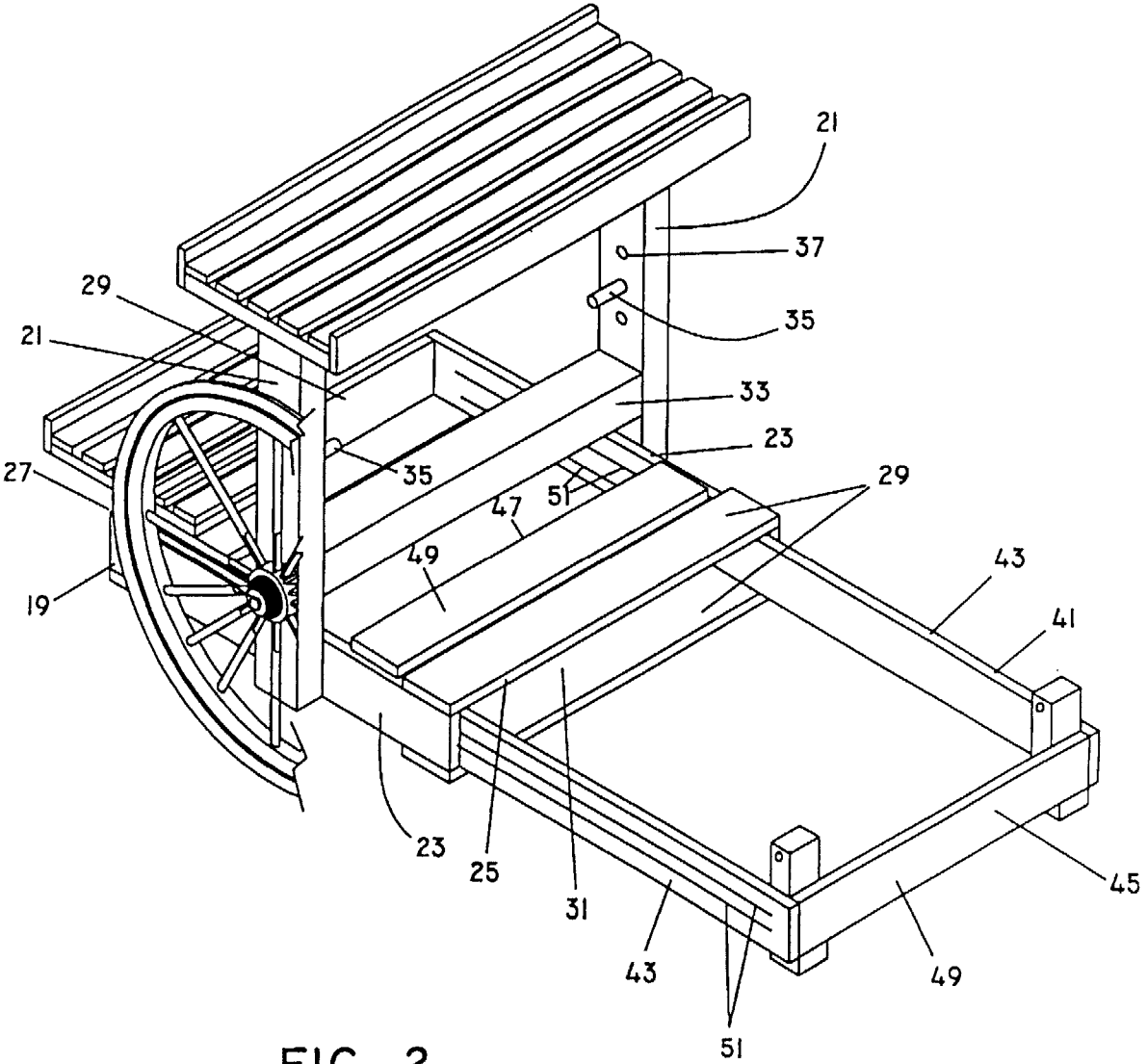
FIG. 2 is an isometric view of the display rack, with the rack removed and part of the wagon wheels cut away.
Figure 3:
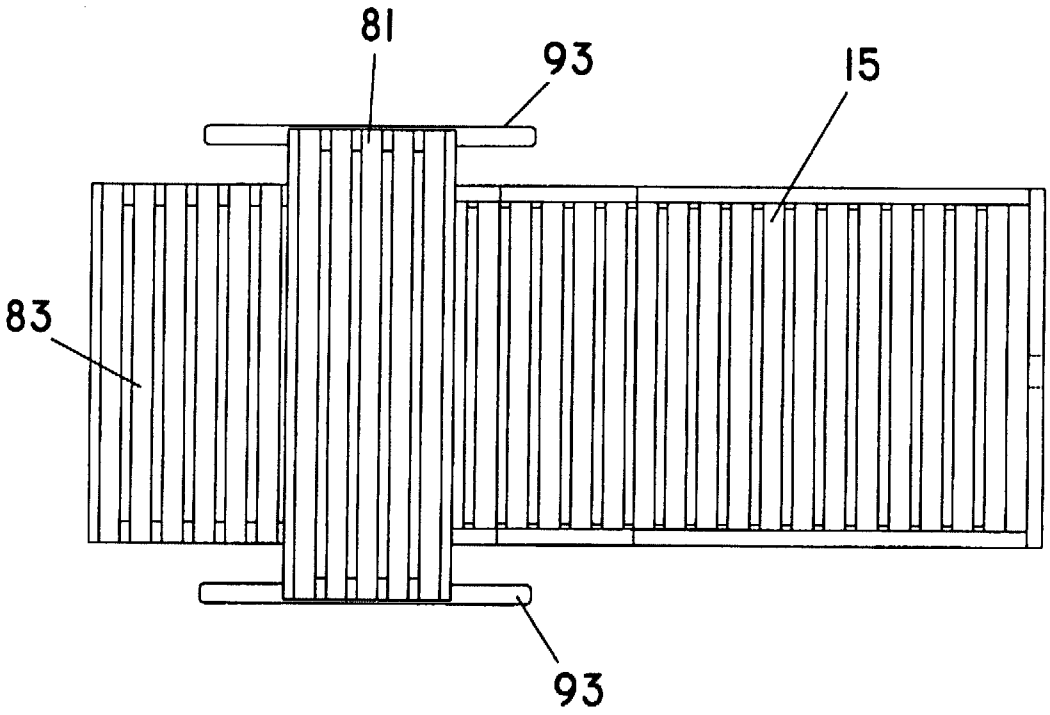
FIG. 3 is a top plan view of the display rack in the fully extended position.

Referring to FIG. 2, the frame 13 has a base 19 and posts 21. The base 19 is generally rectangular (in a plan view). The base 19 has two lateral beams 23, one on each side. The lateral beams 23 are joined together at the front and rear ends 25, 27 by transverse beams 29. Each of the front and rear ends 25, 27 has two transverse beams 29; one transverse beam is located on top of the lateral beams 23, while the other transverse beam is located at the bottom of the lateral beams. Thus, an opening 31 is formed between the respective transverse beams 29 at the front end 25 of the base 19. The rear end 27 of the base 19 need not have an opening therein.

A vertical post 21 is coupled to each lateral beam 23, at a location that is between the front and rear ends 25, 27 of the base 19. The posts 21 extend upwardly. A transverse beam 33 extends between the posts 21 at a location that is above the base 19. The posts 21 have supports 35 thereon that project inwardly towards the opposite post. In the preferred embodiment, the supports are pins 35. The posts can have plural holes 37 therein, located at different heights above the base. The pins 35 can be inserted into the desired holes 37 so as to adjust the inclination of the rack 15.

The base 19 has an extension 41 that is used to couple to one end of the inclined rack 15. The extension 41 is generally rectangular (in a plan view) and is sized to fit within the base 19. The extension 41 has lateral beams 43 that are joined together at their front and rear ends 45, 47 by transverse beams 49. The width (the distance between the lateral beams 49) and the height of the lateral beams of the extension 41 are less than the width and height of the opening 31 at the front end 25 of the base 19. This enables the extension 41 to be received by the base front end opening 31.

The extension 41 can slide out of and into the base 19. Plastic strips 51 are provided along the outside of the extension lateral beams 43 and along the inside of the base lateral beams 23. These strips contact each other and reduce the friction between the extension 41 and the base 19.

The transverse beams 49 of the extension rear end 47 can be located above and below the lateral beams 43, so as to serve as stops against the transverse beams 29 of the base front and rear ends. These stops prevent the extension 41 from being pulled out too far from the base 19, as well as being pushed too far into the base. The length of the lateral beams 43 of the extension is greater than the length of the lateral beams 23 of the base.

Referring to FIG. 6, the rack 15 has a main section 53 and one or more secondary sections 55A, 55B. In the preferred embodiment, there are two secondary sections 55A, 55B. Each section 53, 55A, 55B is generally rectangular in shape (in a plan view). Each section has lateral and transverse members 57, 59. The transverse members 59 form front and rear ends of each section. A top surface or wall 61 is provided. In the preferred embodiment, the top wall is formed by plural slats 63 (see FIG. 1), separated from each other by gaps 65. This slat arrangement provides a pleasing aesthetic appearance.

The main section 53 of the rack has front and rear ends 67, 69. The front end 67 of the main section 53 is pivotally coupled to the front end 45 of the extension 41. Coupling can be by hinges, pins, etc. Such coupling allows the inclination of the rack 15 to be changed from flatter to more sloped. In the preferred embodiment, the front end 67 is pinned 70 to blocks 68 that are coupled to the extension 41. The front end 67 of the main section has a wall 71 that extends generally upwardly. The wall 71 serves as a stop to prevent products from sliding off of the inclined rack 15 onto the floor. The wall 71 has an opening 73 (see FIG. 1) therein, so as to form a handle 75. The handle 75 is useful when manipulating the rack 15 to be shorter or longer.

The secondary section 55A is pivotally coupled (by way of its front end) to the rear end 69 of the main section 53. Coupling can be by hinges, pins, etc. The secondary section 55A can be moved between an inclined position and a stowed position, as well as positions intermediate of the inclined and stowed positions. In the inclined position (see FIG. 6), the top wall 61 of the secondary section 55A is generally in line with the top wall 61 of the main section 53. In its stowed position, the secondary section 55A is oriented so as to be horizontal, while the main section is inclined (see FIGS. 7 and 8). The coupling between the sections 53, 55A allows such movement. For example, the front transverse member 59 of the secondary section 55A, can be hinged to the rear transverse member of the main section 53. The hinge is located along the bottom edges of the transverse members. This arrangement allows the secondary section 55A to swing down relative to the rear end of the main section 53 toward the base 19, as well as allows the secondary section 55A and the main section 53 to form a single rack that can bear the weight of products.

The other (or second) secondary section 55B is coupled, by way of its front end, to the rear end of the first secondary section 55A. The coupling is pivotal and is substantially similar to the coupling between the first secondary section 55A and the main section 53. The second secondary section 55B can pivot so as to be in line with the other sections 53, 55A (see FIG. 6) or so as to be at an angle to the first secondary section 55A (see FIG. 7).

The rack 15 can be provided with steps or ribs (not shown) on the top wall 61 to prevent products from sliding down the rack.

Still referring to FIG. 6, the display rack 11 has a top shelf 81 that extends between the top ends of the posts 21. There is also provided a rear shelf 83 at the rear end 27 of the base 19. Both shelves have top walls 85 (see FIG. 1) suitable for supporting products. The top walls can be slatted or continuous. Upstanding lips 87 can be provided along selected edges of the top walls 85 to retain products thereon.

The display rack 11 has legs 17 that bear on the floor. There are legs 17 on the front end 25 and the rear end 27 of the base 19. The front end 45 of the extension 41 also has legs 17. The legs 17 are coupled to either the lateral or transverse beams 23, 29, 43, 49 of the respective base or extension. The bottom of each leg is provided with a conventional and commercially available wheel or caster 91. The caster is provided with a releasable lock or brake to selectively allow or prevent rotation of the wheel. There is also provided a wagon type wheel 93 on each side of the display rack 11. The wagon wheels 93 add aesthetic appeal to the display rack. The wagon wheels 93 are rotatably coupled to the vertical posts 21.

The operation of the display rack 11 will now be described. In FIGS. 1 and 6, the display rack 11 is shown with the rack 15 in its fully extended position. The extension 41 is fully extended out from the base 19 (the rear transverse beam 49 of the extension 41 abuts against the front transverse beam 29 of the base as shown in FIG. 6). The main and secondary sections 53, 55A, 55B are positioned so as to form an inclined rack 15 that extends from the posts 21 to the front end 45 of the extension 41. The rear end portion of the secondary section 55B is received between the posts 21 and bears on the pins 35.

Products can be placed on all sections 53, 55A, 55B of the rack, as well as on the top and rear shelves 81, 83.

To reduce the amount of rack 15 that is available for displaying products, the extension 41 is pushed or retracted into the base 19. This can be accomplished by pushing on the wall 71. The second secondary section 55B is pushed to a location rearwardly of the pins 35. The second secondary section 55B is allowed to swing down towards the base 19 as shown in FIG. 7. The rear portion of the first secondary section 55A is now supported by the pins 35. The inclined rack has been shortened to adjust the main section 53 and the first secondary section 55A, both of which are inclined. The second secondary section 55B is in a vertical orientation (or in a rearwardly inclined orientation). Products can be placed on the main and first secondary sections 53, 55A, as well as on the top and rear shelves 81, 83.

The amount of inclined rack 15 can be reduced even further by pushing or retracting in the extension 41 into the base 19 an additional distance. Referring to FIG. 8, the first secondary section 55A is now horizontal and is supported the pins 35 at the front end of the first secondary section 55A. The second secondary section 55B remains either vertical or in a rearwardly inclined orientation. Products can be placed on the inclined main section 53 and also on the horizontal first secondary section 55A. In addition, products can be placed on the top and rear shelves 81, 83.

The extension 41 could be pushed in until the main section 53 bears on the pins. The main section 53 is inclined, while the first secondary section 55A can remain horizontal (being supported by a vertical or rearwardly oriented second secondary section 55B) or the first secondary section can also be inclined rearwardly. Products can be placed on the inclined main section 53, and the first secondary section 55A, as well as on the top shelf 81. The rear shelf 83 may be obscured by the secondary sections.

To lengthen the display rack 11, the extension 41 is pulled out from the base 19 until the desired amount of rack is obtained.

The overall length of the display rack 11 shown in FIG. 6 is greater than the overall length of the display rack shown in FIG. 7, which in turn is greater than the overall length of the display rack shown in FIG. 8. Thus, by adjusting the position of the extension 41 relative to the base 19, the length of the display rack, and the amount of rack 15 that is inclined or otherwise available for use in displaying products, can be changed.

The sections 55A, 55B, 53 of the rack can be provided with notches that receive the pins 35.

The foregoing disclosure and the showings made in the drawings are merely illustrative of the principles of this invention and are not to be interpreted in a limiting sense.

We claim:

1. A display, comprising:

a) a frame having a base and posts extending therefrom, the posts having supports thereon, the supports being separated from the base by a distance;

b) an extension having first and second ends, with the second end slidingly engaging the base so as to move between an extended position and a partially extended position, with the first end of the extension being closer to the base when the extension is in the partially extended position than when the extension is in the fully extended position;

c) a rack having a main section and a secondary section, the main section having first and second ends, with the first end of the main section being pivotally coupled to the first end of the extension, with the second end of the main section being pivotally coupled to the secondary section;

d) the rack being received between the posts and bearing on the supports such that the main section of the rack is inclined to the base, with the secondary section having the same inclination as the main section when the extension is in the extended position and with the secondary section having a different inclination from the inclination of the main section when the extension is in the partially position.

2. The display of claim 1 wherein when the extension is in the partially extended position, the secondary section of the rack is horizontal.

3. The display of claim 1 wherein when the extension is in the partially extended position, the secondary section of the rack depends towards the base.

4. The display of claim 1 further comprising legs on the base and the extension.

5. The display of claim 4 wherein the legs comprise wheels.

6. The display of claim 1 further comprising wagon type wheels coupled to the posts.

7. The display of claim 1 further comprising a shelf located on the base, the shelf being located such that the posts are between the shelf and the first end of the rack main section.

8. The display of claim 1 wherein:

a) when the extension is in the partially extended position, the secondary section of the rack depends towards the base;

b) the display comprises legs on the base and the extension;

c) the legs comprise wheels;

d) a shelf is located on the base, the shelf being located such that the posts are between the shelf and the first end of the rack main section.

* * * * *